United States Patent [19]

Federico et al.

[11] Patent Number: 4,588,284

[45] Date of Patent: May 13, 1986

[54] CONTROL SYSTEM

[75] Inventors: Anthony M. Federico, Webster; Kenneth R. Kaisen; Ernest L. Legg, both of Fairport, all of N.Y.

[73] Assignee: Xerox Corporation, Stamford, Conn.

[21] Appl. No.: 528,768

[22] Filed: Sep. 2, 1983

[51] Int. Cl.[4] ..... G03G 15/00

[52] U.S. Cl. ..... 355/14 R; 355/14 C; 355/16

[58] Field of Search ..... 355/14 C, 14 R, 16, 355/14 SH

[56] References Cited

U.S. PATENT DOCUMENTS 3,917,396 11/1975 Donohue et al. ..... 355/14 R
4,130,354 12/1978 Steiner ..... 355/14 C
4,465,360 8/1984 Yamagishi et al. ..... 355/14 SH X
4,468,114 8/1984 Pels et al. ..... 355/14 R
4,475,156 10/1984 Federico et al. ..... 364/300
4,509,851 4/1985 Ippdito et al. ..... 355/14 C

*Primary Examiner*—Arthur T. Grimley
*Assistant Examiner*—C. Romano
*Attorney, Agent, or Firm*—R. F. Chapuran

[57] ABSTRACT

A control system is provided to automatically alter the control of a machine to respond to a different number of pitches or images that the machine can manage at one time. A flag in memory is monitored and in response to the flag, the machine control is adjusted to manage a different number of pitches during the operation of the machine and to provide clock signals for the timed actuation of events in each of the pitches.

7 Claims, 6 Drawing Figures

DCR
78
MIR
76
XER
74
PHR
72
CPM
70
88
80
WDT
M. CLK
PR
RSE
FIN
OUTPUTS
DIGITAL OUT
ANALOG OUT
PAPER DRIVES
MACHINE SENSORS SWITCHES
ANALOG IN
MACHINE SENSORS & SWITCHES
M. CLK
50
27
CONTROL PANEL
86
MMB
84
RDHR
82
DOCUMENT DRIVES
SWITCH INPUT 10
90a
REG. FINGERS
92
M.CLK SENSOR
66
90b
72
PHR
PITCH RESET
70
CPM

CONTROL SYSTEM

This invention relates to an electronic control and, in particular, to an improved control for a reproduction machine.

In a reproduction machine, the photoconductive belt is often divided into "pitches". Each pitch represents one image at various states of the reproduction process. Usually, there are more than one image or pitch on the belt at any one time. In the control of the reproduction machine, therefore, to time various events related to various pitches, it is necessary to track according to each pitch the time that a particular event should occur in relation to that particular pitch. This is done by timed clock signals related to each pitch in order to synchronize the events of the machine and coordinate the various events.

In other words, for example, machines of the endless belt type employ various processing stations that uniformly charge, expose, develop, transfer, clean and fuse during any cycle of copying. For high speed operation of these machines, it becomes very important that there be a proper base for the timing sequence of operation of the processing stations in order to maintain proper registration of the processing functions relative to images. In controlling the operation of the machine, there must be provisions for efficient and reliable movement of sheets of copy paper along the paper path of the machine and in particular for timely presentation of the sheets in succession to the transfer station of the machine in timed sequence relative to the production of electrostatic latent images. It is known to provide a control system having means for providing a series train of clock pulses, means for generating reset or start pulses in succession for each of the processing cycles, and logic means for generating a plurality of timed control signals derived from the start and clock pulses for enabling various processing stations to implement the machine processing steps timely. In particular, U.S. Pat. No. 3,917,396 shows start or reset pulses keyed to the displacement or position of the photoreceptor belt which is sensed by a speed responsive element preferably in the form of the transfer roller used for transferring the image to the copy sheet. In addition, it teaches a system adapted to generate more than one cycle of enabling pulses to process more than one copying process in the machine at any given moment.

Generally, however, the number of pitches per the belt in a specific machine is fixed. This can limit the adaptability of the machine and the control to other applications. It would be desirable, therefore, to not only be able to control tasks for a given number of pitches and machine clocks within the pitch but also to be able to control tasks based on the pitch and the machine clocks within the pitch when the number of pitches within the machine has changed.

It is an object of the present invention, therefore, to provide a new and improved machine control system. It is a further object of the present invention to provide a control system that allows the control of tasks based on a given pitch and clock signals within the pitch. It is a further object of the present invention to provide a control system that allows the operating system to control operation based on the pitches within a machine when the number of pitches has been changed, that is the number of images at various stages within the machine is variable. It is a further object of the present invention to provide a suspension mechanism for the timing of events wherein the number of clock signals per pitch varies. Further advantages of the present invention will become apparent as the following description proceeds, and the features characterizing the invention will be pointed out with particularity in the claims annexed to and forming a part of this specification.

Briefly, the present invention is the means to automatically alter the control of a machine to respond to a different number of pitches or images that the machine can manage at one time. A flag in memory is monitored and in response to the flag, the machine control is adjusted to manage a different number of pitches during the operation of the machine and to provide clock signals for the timed actuation of events in each of the pitches.

For a better understanding of the present invention, reference may be had to the accompanying drawings wherein the same reference numerals have been applied to like parts and wherein.

Figure 1:
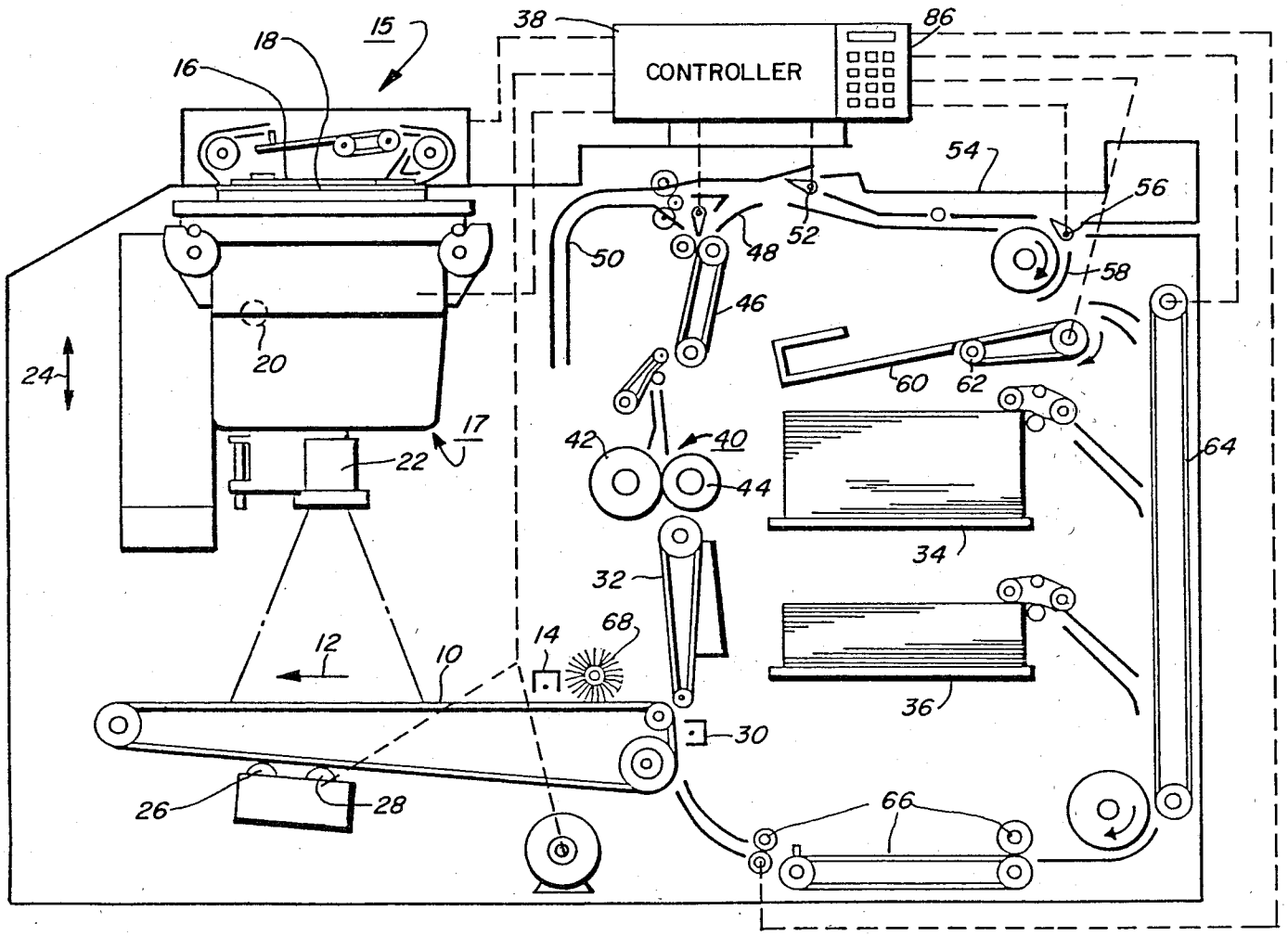
FIG. 1 is an elevational view of a reproduction machine typical of the type of machine or process that can be controlled in accordance with the present invention.

With reference to FIG. 1, there is shown an electrophotographic printing or reproduction machine employing a belt 10 having a photoconductive surface. Belt 10 moves in the direction of arrow 12 to advance successive portions of the photoconductive surface through various processing stations, starting with a charging station including a corona generating device 14. The corona generating device charges the photoconductive surface to a relatively high substantially uniform potential.

The charged portion of the photoconductive surface is then advanced through an imaging station. At the imaging station, a document handling unit 15 positions an original document 16 facedown over exposure system 17. The exposure system 17 includes lamp 20 illuminating the document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge. This records an electrostatic latent image on the photoconductive surface corresponding to the informational areas contained within the original document.

Platen 18 is mounted movably and arranged to move in the direction of arrows 24 to adjust the magnification of the original document being reproduced. Lens 22 moves in synchronism therewith so as to focus the light image of original document 16 onto the charged portion of the photoconductive surface of belt 10.

Document handling unit 15 sequentially feeds documents from a holding tray, in seriatim, to platen 18. The document handling unit recirculates documents back to the stack supported on the tray. Thereafter, belt 10 advances the electrostatic latent image recorded on the photoconductive surface to a development station.

At the development station a pair of magnetic brush developer rollers 26 and 28 advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to the transfer station. At the transfer station a copy sheet is moved into contact with the toner powder image. The transfer station includes a corona generating device 30 which sprays ions onto the backside of the copy sheet. This attracts the toner powder image from the photoconductive surface of belt 10 to the sheet.

The copy sheets are fed from a selected one of trays 34 or 36 to the transfer station. After transfer, conveyor 32 advances the sheet to a fusing station. The fusing station includes a fuser assembly for permanently affixing the transferred powder image to the copy sheet. Preferably, fuser assembly 40 includes a heated fuser roller 42 and backup roller 44 with the sheet passing between fuser roller 42 and backup roller 44 with the powder image contacting fuser roller 42.

After fusing, conveyor 46 transports the sheets to gate 48 which functions as an inverter selector. Depending upon the position of gate 48, the copy sheets will either be deflected into a sheet inverter 50 or fed directly onto a second gate 52. Decision gate 52 deflects the sheet directly into an output tray 54 or deflects the sheet into a transport path which carries them on without inversion to a third gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60. Duplex tray 60 provides intermediate or buffer storage for those sheets which have been printed on one side for printing on the opposite side.

In order to complete duplex copying, the previously simplexed sheets in tray 60 are fed seriatim by bottom feeder 62 back to the transfer station for transfer of the toner powder image to the opposed side of the sheet. Conveyers 64 and 66 advance the sheet along a path which produces a sheet inversion. The duplex sheets are then fed through the same path as the previously simplexed sheets to be stacked in tray 54 for subsequent removal by the printing machine operator.

Invariably after the copy sheet is separated from the photoconductive surface of belt 10, some residual particles remain adhering to belt 10. These residual particles are removed from the photoconductive surface thereof at a cleaning station. The cleaning station includes a rotatably mounted fibrous brush 68 in contact with the photoconductive surface of belt 10.

A controller 38 and control panel 86 are also illustrated in FIG. 1. The controller 38, as represented by dotted lines, is electrically connected to the various components of the printing machine.

Figure 2:
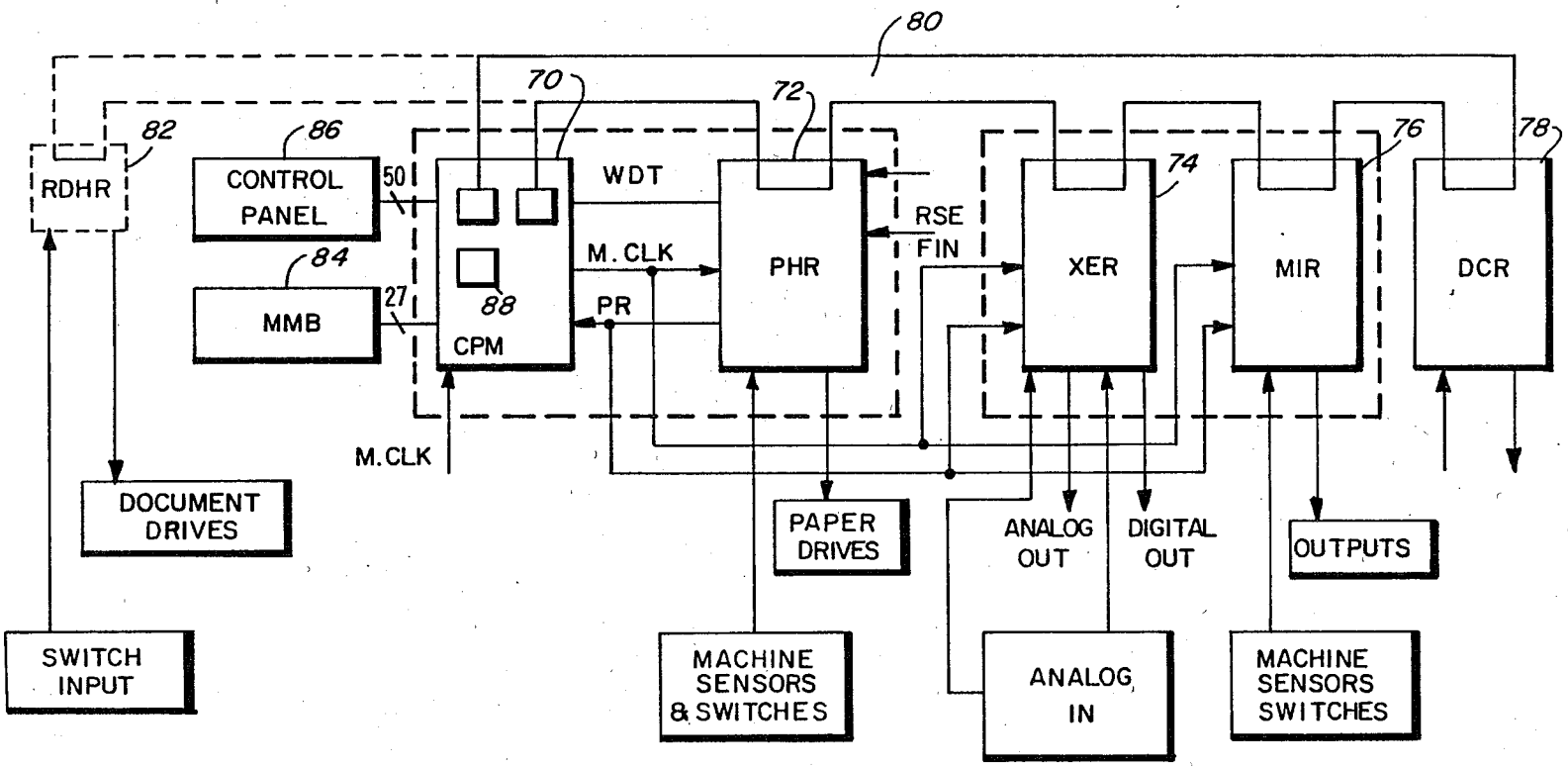
FIG. 2 is a block diagram of a first level of control architecture for controlling the machine of FIG. 1.

With reference to FIG. 2, there is shown a first level of control architecture of controller 38 illustrated in FIG. 1. In accordance with the present invention, in particular, there is shown a Central Processing Master (CPM) control board 70 for communicating information to and from all the other control boards, in particular the Paper Handling Remote (PHR) control board 72 controlling the operation of all the paper handling subsystems such as paper feed, registration and output transports.

Other control boards are the Xerographic Remote (XER) control board 74 for monitoring and controlling the xerographic process, in particular the digital signals; the Marking and Imaging Remote (MIR) control board 76 for controlling the operation of the optics and xerographic subsystems, in particular the analog signals. A Display Control Remote (DCR) control board 78 is also connected to the CPM control board 70 providing operation and diagnostic information on both an alphanumeric and liquid crystal display. Interconnecting the control boards is a shared communication line 80, preferably a shielded coaxial cable or twisted pair similar to that used in a Xerox Ethernet® Communication System. For a more detailed explanation of an Ethernet® Communication System, reference is made to Copending Applications U.S. Ser. No. 205,809; U.S. Ser. No. 205,822 and U.S. Ser. No. 205,821, all filed Nov. 10, 1980 and incorporated herein as references.

Other control boards can be interconnected to the shared communication line 80 as required. For example, a Recirculating Document Handling Remote (RDHR) control board 82 (shown in phantom) can be provided to control the operation of a recirculating document handler. There can also be provided a not shown Semi-Automatic Document Handler Remote (SADHR) control board to control the operation of a semi-automatic document handler, a not shown Sorter Output Remote (SOR) control board to control the operation of a sorter, and a not shown Finisher Output Remote (FOR) control board to control the operation of a stacker and stitcher.

Each of the controller boards preferably includes an Intel 8085 microprocessor with suitable RAM and ROM memories. Also interconnected to the CPM control board is a Master Memory Board (MMB) 84 with suitable ROMs to control normal machine operation and a control panel board 86 for entering job selections and diagnostic programs. Also contained in the CPM board 70 is suitable nonvolatile memory. All of the control boards other than the CPM control board are generally referred to as remote control boards.

In a preferred embodiment, the control panel board 86 is directly connected to the CPM control board 70 over a 70 line wire and the memory board 84 is connected to the CPM control board 70 over a 36 line wire. Preferably, the Master Memory Board 84 contains 56K byte memory and the CPM control board 70 includes 2K ROM, 6K RAM, and a 512 byte nonvolatile memory. The PHR control board 72 includes 1K RAM and 4K ROM and preferably handles 29 inputs and 28 outputs. The XER control board 74 handles 24 analog inputs and provides 12 analog output signals and 5 digital output signals and includes 4K ROM and 1K RAM. The MIR board 76 handles 13 inputs and 17 outputs and has 4K ROM and 1K RAM.

As illustrated, the PHR, XER and MIR boards receive various switch and sensor information from the printing machine and provide various drive and activation signals, such as to clutches and lamps in the operation of the printing machine. It should be understood that the control of various types of machines and processes are contemplated within the scope of this invention.

Figure 3:
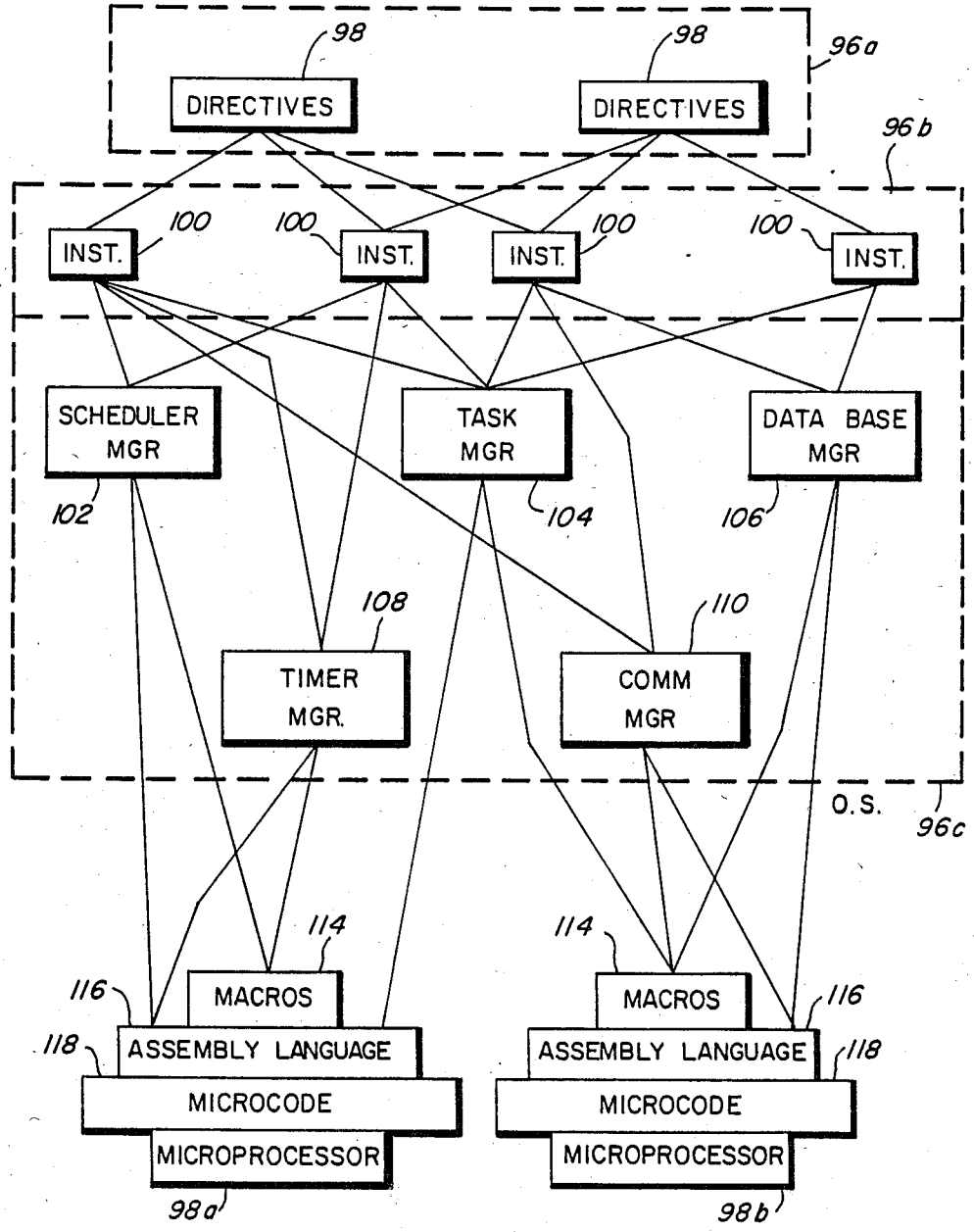
FIG. 3 illustrates a second level of control architecture controlling the machine of FIG. 1.

With reference to FIG. 3, there is shown a second level of control architecture, an Operating System (O.S.). The Operating System is shown by the dotted line blocks indicated by the numerals 96*a*, 96*b* and 96*c*. The Operating System is shown in communication with the macros and assembly language instructions of a pair of microprocessors 98*a* and 98*b*. The Operating System could communicate with any number of microprocessors, for example, the microprocessors of each of the control boards 70, 72, 74, 76, 78 and 82 shown in FIG. 2. The Operating System overlies the control architecture of FIG. 2 and, in general, acts as a manager of the various resources such as the CPM and remote board microprocessors and the ROM and RAM memories of each of the control boards. In accordance with the present invention, the Operating System converts the microprocessor hardware into a virtual machine in controlling the printing machine shown in FIG. 1. By virtual machine is meant that portion of the control illustrated by numerals 96*a*, 96*b* and 96*c* that surround the system hardware.

With reference to FIG. 3, the Operating System is presented with a plurality of Directives 98. These Directives call upon one or more decoders or Instruction Modules 100. In turn, the Instruction Modules 100 invoke one or more Primitives. In particular, the Primitives are a Scheduler Manager 102, a Task Manager 104, a Data Base Manager 106, a Timer Manager 108 and a Communication Manager 110. In turn, the Primitives communicate with the various microprocessors 98*a*, 98*b* through the macros 114, the assembly language 116 and the microcode 118 of the microprocessors 98*a*, 98*b*. The invoking of Instruction Modules and Primitives is illustrated in FIG. 3 by the solid lines connecting the Directives (98), Instruction Modules (100) and Primitives (102, 104, 106, 108, 110). It should be noted that each of the microprocessors 98*a* and 98*b* is suitably connected to suitable RAM and ROM memories as well as with other microprocessors.

Directives corresponding to macros in a physical machine (microprocessor) architecture are the top level of the operating control. The Directives shield the Operating System structure from changes in the compiler, allow for changes in the Operating System internal structure and abstract out from the compiler unnecessary Operating System details. Instruction Modules and Primitives make up the Operating System. Instruction Modules are the middle level and correspond to assembly language instructions in a physical machine. They are the smallest executable, nonpreemptive unit in the virtual machine. Preemption is similar to a physical machine interrupt capability except that a physical machine allows basically two concurrent processes or tasks (foreground or background) whereas the virtual machine allows an almost unlimited number of tasks executing in one or more physical processors.

The Primitives are the lowest level in the Operating System. They correspond to the microcode of a microprocessor. It is the function of the Primitives to implement the basic building blocks of the Operating System on a microprocessor and absorb any changes to the microprocessor. In general, Directives call upon one or more Instruction Modules which in turn invoke one or more of the Primitives to execute a task or process.

Preferably, the Instruction Modules 100 and the Primitives 102, 104, 106, 108 and 110 comprise software in silicon. However, it should be understood that it is within the scope of the present invention to implement the Instruction Modules and Primitives in hardware. They are building blocks in an overall control system. In particular, the Instruction Modules and Primitives generally provide a set of real time, multitasking functions that can be used generically across different implementations of the microprocessors. In a machine or process control, the Instruction Modules and Primitives are extensions of the instruction set of the microprocessor. The microprocessor with its original set of Instruction Modules acts as a kernel, and the software and silicon or firmware acts as a shell. For a more detailed description of the control, reference is made to pending U.S. Ser. No. 420,993 incorporated herein.

Figure 4:
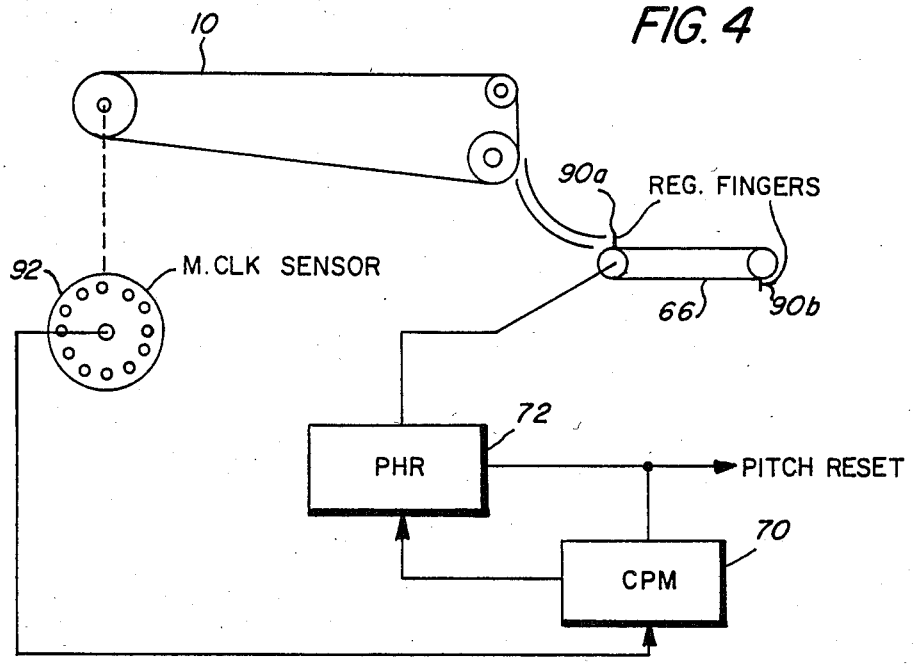
FIG. 4 illustrates the basic timing signals used in the control of the machine of FIG. 1.

A master timing signal, called the timing reset or Pitch Reset signal, as shown in FIG. 4, is generated by PHR board 72 and used by the CPM, PHR, MIR and XER control boards 70, 72, 74 and 76. With reference to FIG. 4, the Pitch Reset signal is generated in response to a sensed registration finger. Two registration fingers 90*a*, 90*b* on conveyor or registration transport 66 activate a suitable (not shown) sensor to produce the registration finger signal. The registration finger signal is conveyed to suitable control logic on the PHR control board 72.

In addition, a Machine Clock signal (MCLK) is conveyed to PHR 72 via the CPM control board 70 to suitable control logic. In response to predetermined MCLK signals, the pitch reset signal is conveyed to the CPM board 70 and the PIR and the XER remotes 74, 76. The Machine Clock signal is generated by a timing disk 92 or Machine Clock sensor connected to the main drive of the machine. The Machine Clock signal allows the remote control boards to receive actual machine speed timing information.

The timing disk 92 rotation generates approximately 1,000 machine clock pulses per second. A registration finger sensed signal occurs once for each paper feed and in one mode there are approximately 830 machine clock counts for every registration finger sensed signal as shown in FIG. 4. A belt hole pulse is also provided to synchronize the seam on the photoreceptor belt 10 with the transfer station to assure that images are not projected onto the seam of the photoreceptor belt.

For more details of the timing, reference is made to Copending Application U.S. Ser. No. 420,993, incorporated herein.

A reproduction machine is generally divided into a xerographic process path and a paper path. In the xerographic process path, the photoconductor belt or web rotates at a uniform speed as it is driven by a motor. The belt passes various processing stations, such as the exposure, development, transfer and charging stations. The paper path includes a paper feeding station, transfer station and the fusing station.

Certain steps such as imaging, image transfer and feeding of the paper at the transfer station are precisely timed. Also, the monitoring steps such as the detection of the jam conditions along the paper path or detection of the undesired presence of the sheet on the belt, are precisely timed during the machine process.

However, there are other events or process steps which have to take place in a certain sequence but which do not require precise timing. Thus, the developing of the image at the imaging station and the charging of the photoconductor belt at the charging station need not be as precisely timed though they must occur in a certain sequence.

Also, the movement of the paper in the paper path need not be at the same speed as that of the photoconductor belt, except at the point where image is transferred. In addition, the travel of the paper need not be maintained at a uniform speed as the paper traverses its path. Thus, the paper may be brought up very speedily to a registration point. But at the registration point it must be fed into the transfer roller at the same rate as the rate at which the photoconductor belt travels. After the image transfer takes place and the paper leaves the roller, it may then travel at any speed to the fusing station. What is critical is that at the transfer station, the paper travels synchronously with the traveling speed of the image on the photoconductor belt.

The xerographic path and paper path can be subdivided into uniformly spaced zones or "pitches". The spatial sections relate to the timing of the images being processed. In the xerographic path, the physical distance transversed by the image across the successive zones or pitches are the same because the belt travels at a constant speed. But the physical spacing in the paper path does not correspond to the speed with which paper travels because the paper travels at different speeds in different zones along its path.

Within each of the zones or pitches certain processing steps occur. That is, the exposure takes place at one pitch, the development takes place at another pitch, and the cleaning takes place at still another pitch. In the paper path, the paper is fed at still another zone or pitch. In terms of timing, certain of these events must take place at a particular point and space in time in these pitches, as the images are formed and travel with the photoconductor path, transferred to the paper and then travels along the paper path. Note that the events or steps taking place in these pitches may take place concurrently. In other words, in a machine there are a given number of reproductions in process at a given time. For a more detailed description of this type of timing, reference is made to U.S. Pat. No. 3,917,396, incorporated herein.

In accordance with the present invention, a construct decoder responsive to a specific construct of instruction is provided to respond to a variable number of pitches within a machine or to alter the number of machine clocks within a pitch to control machine events. In operation, a flag in memory MMB 84 or any other suitable memory location is monitored by CPM 70. In a preferred embodiment, the flag will determine whether or not the machine is to accommodate the control of four or five pitches.

Thus, either four or five pitches with an associated number of clock signals corresponding to images on the photoreceptor and the disposition of a copy with respect to a particular image on the photoreceptor will be controlled. Each pitch is divided into a number of clock signals. Within each pitch, a given number of clock signals determines the "wake up" or activation of a particular event related to that particular pitch, such as actuation of exposure lamp, fuser or copy sheet feed.

The representation of a particular pitch and number of clock signals within the pitch is provided by the construct "WAIT", PR, Residue, where "PR" represents the pitch number and "Residue" represents the number of clock pulses after that particular pitch number for the event to be performed or a task to resume execution. The pitch number is usually determined by the reset pulse to be able to count or track the various pitches. A pitch number zero (0) implies that the task or event will occur at the next occurrence of the clock pulse count or residue.

An example will illustrate the versatility of the WAIT construct.

EXAMPLE

Figure 5:
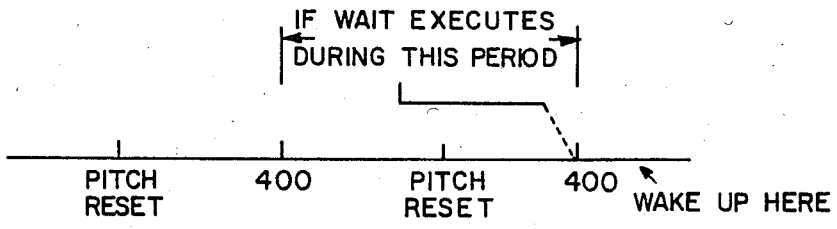
FIGS. 5 and 6 illustrate the reset and clock signal relationship in the activation of an event within a given pitch.

DECLARE NEXT LITERALLY "0";

WAIT NEST PR, 400;

This will be handled as follows: A check will be made to determine if clock count 400 has occurred during the current pitch. If it has not yet occurred, the current task will be suspended, and it will wake up at clock count 400 of this pitch. If it is currently after clock count 400 of the pitch, the task will be suspended until clock count 400 of the following pitch. Thus, the window for being activated at a specific clock count in a pitch is one pitch worth of machine clocks prior to the desired clock count as illustrated in FIG. 5. Thus, with this construct, we are able to supply control timing from two potentially independent signals, the pitch reset and the machine clock. A variation of this scheme allows NEXT to be replaced by a number so suspension can be set up several pitches prior to its being required.

Figure 6:
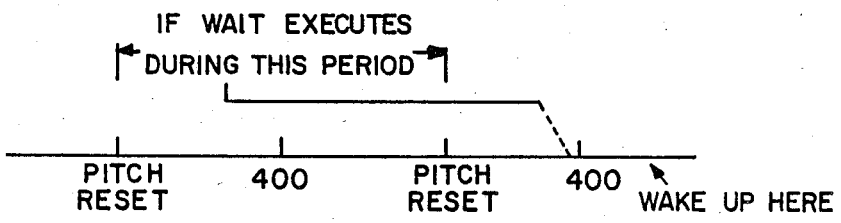

A less preferred implementation of the WAIT construct is a response to a "WAIT" on a calculated number of machine clocks, where the number of machine clocks is calculated on a fixed number of machine clocks per pitch as shown in FIG. 6. There are two basic problems associated with this implementation. First, the number of machine clocks per pitch is not always constant, and thus additional error can be introduced. In the preferred embodiment, this error is not introduced because the machine clock is resynchronized on each pitch reset. In the case where the suspension occurs, several pitches prior to the wake up, this error can be very severe. Second, for machines running in a variable pitch mode, (example 4/5), the number of machine clocks per pitch is different, so these "WAITs" will resolve at the wrong time.

It is, therefore, preferable to actually wait for the specified number of pitch resets and then use the residue. This will solve the variability problem, and also work in a machine having a different number of pitches. It is only necessary to read in non-volatile memory an indication of the number of pitches in the machine. The control will respond to the number of pitches.

Appendix A is a listing of a preferred method of implementing the WAIT construct.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. A processing system for producing copies of an original, the system having a plurality of operating components, a movable photoreceptor belt and a first plurality of in process images including, means for producing latent images on said belt, said latent images being one portion of said in process images, development means for applying development material to each of the latent images to develop the latent images, a transfer station adjacent the moving belt, means for feeding seriatim sheets of copy material from a supply station to said transfer station to transfer developed images to said sheets, said developed images on said sheets being another portion of said in process images, means for generating a first series of control pulses on equal cycles, said control pulses associated with each of the first plurality of in process images for controlling the operation of the operating components on the first plurality of in process images to produce said copies of an original, means to alter the number of the first plurality of in process images to a second plurality of in process images, and means to generate a second series of control pulses associated with the second plurality of in process images for controlling the operation of the operating components on the second plurality of in process images to produce said copies of an original.

2. In an electrophotographic apparatus having an elongated electrophotosensitive member adapted to have a plurality of electrostatic images formed on a surface thereof, and having a copy sheet supply for feeding sheets along a paper path comprising a plurality of actuatable work stations operative when actuated for forming said plurality of electrostatic images, means for moving the member along an endless path relative to said plurality of actuatable work stations, and means for sequentially actuating and de-actuating said work stations in timed relation to movement of the member past predetermined positions aling said path, including means associated with said electrophotosensitive member moving means controlling a plurality of pitches, each pitch being related to the position of the member along the endless path, and to the status of a copy sheet, means coupled to said moving means and effective to produce clock signals in response to movement of the member along the path;

timing means responsive to said clock signals and having a plurality of states, the present state of which is representative of the total cumulative number of said clock signals;

means coupled to said timing means and responsive to particular ones of said pitches and particular ones of the present states of said timing means to effect sequential operation of said work stations with respect to said surface of the member during movement of the member along the endless path respectively, and means to alter the number of said plurality of pitches.

3. An electrostatic printing apparatus for reproducing copies of an original having a movable photoreceptor member including, means for producing a plurality of electrostatic latent images on said member, development means for applying developing material to each of the latent images, a transfer station adjacent the moving photoreceptor member at which each developed image is transferred, means for feeding copy material from a supply thereof to said transfer station for transfer of the developed image to the copy material, control means associated with said image producing means and said copy material feeding means for providing processing signals related to each of the plurality of images, means for altering the number of latent images on said member, and timing means responsive to said means for altering to control the feeding means in timed sequence with said member.

4. A document processing system for reproducing an original representation on copy material comprising; a continuous elongated photoreceptor element, means for driving said photoreceptor in a direction along an elongated length, optical means for placing an image of said original on a surface area of said photoreceptor element, developing means for developing said image, feed means for feeding a copy material surface to said photoreceptor image area, transfer means for transferring said image to said copy material surface, output means for receiving said image copy material surface, sequencing control means, said sequencing control means including a plurality of pitches, means for sequentially energizing said pitches in accordance with each reproduction, means responsive to a condition of associated ones of said pitches for enabling said optical means, said feed means and said transfer means, timing control means, said timing control means providing a series of timing signals for each of said energized pitches, and switching means coupled to said sequencing control means and said timing control means and responsive to said associated enabling pitches and to a predetermined timing control subsequence for energizing said respective optical means, feed means, development means and transfer means, wherein the improvement comprises the means to alter the number of said pitches.

5. The system of claim 4 including the means to alter the number of timing signals for each of the pitches.

6. A method of controlling a reproduction machine having a photosensitive surface supporting a first number of in process latent images, a plurality of operating components cooperating with one another and the photosensitive surface to produce impressions on a copy sheet, and a control for providing first clock signals for the activation of the operating components to produce said in process latent images comprising the steps of:

producing impressions of copy sheets in response to said first number of in process latent images, altering said first number of in process latent images to a second number of in process latent images, and providing second clock signals for each image in process for the activation of the operating components associated with the second number of in process latent images to produce the impressions on support material.

7. The method of claim 6 including the step of monitoring a flag in memory to determine an alteration of said first number of in process latent images.

* * * * *